US010378392B2

(12) United States Patent
Aumann et al.

(10) Patent No.: US 10,378,392 B2
(45) Date of Patent: Aug. 13, 2019

(54) DEVICE AND METHOD FOR OPERATING A THERMODYNAMIC CYCLE

(71) Applicant: ORCAN ENERGY AG, Munich (DE)

(72) Inventors: Richard Aumann, Munich (DE); Daniela Walter, Rosenheim (DE); Roy Langer, Munich (DE); Jens-Patrick Springer, Munich (DE); Nicolas Restrepo, Munich (DE)

(73) Assignee: ORCAN ENERGY AG, Munich (DE)

( * ) Notice: Subject to any disclaimer, the term of this patent is extended or adjusted under 35 U.S.C. 154(b) by 141 days.

(21) Appl. No.: 15/523,265

(22) PCT Filed: Sep. 23, 2015

(86) PCT No.: PCT/EP2015/071873
§ 371 (c)(1),
(2) Date: Apr. 28, 2017

(87) PCT Pub. No.: WO2016/066338
PCT Pub. Date: May 6, 2016

(65) Prior Publication Data

US 2017/0328242 A1 Nov. 16, 2017

(30) Foreign Application Priority Data

Oct. 31, 2014 (EP) ..... 14191245

(51) Int. Cl.
*F01K 25/08* (2006.01)
*F01K 9/00* (2006.01)
(Continued)

(52) U.S. Cl.
CPC ..... *F01K 25/08* (2013.01); *F01K 9/00* (2013.01); *F25B 39/02* (2013.01); *F28B 7/00* (2013.01); *F28D 15/06* (2013.01)

(58) Field of Classification Search
CPC ..... F01K 25/08; F28D 15/06; F25B 39/02; F28B 7/00
See application file for complete search history.

(56) References Cited

U.S. PATENT DOCUMENTS 4,506,508 A * 3/1985 Coers ..... F01K 9/003 165/110
5,548,958 A * 8/1996 Lewis ..... F01K 9/00 60/693
(Continued)

FOREIGN PATENT DOCUMENTS

DE 102009026238 A1 2/2010
FR 2935737 A1 3/2010
(Continued)

OTHER PUBLICATIONS

European Office Action for European Patent Application No. EP14191245.1 dated Feb. 28, 2017.

*Primary Examiner* — Mark A Laurenzi
*Assistant Examiner* — Shafiq Mian
(74) *Attorney, Agent, or Firm* — Moore & Van Allen PLLC; Henry B. Ward, III

(57) ABSTRACT

The invention relates to a device for operating a thermodynamic cycle, in particular an ORC process, comprising: a feed pump for conveying liquid working medium to an evaporator by increasing the pressure; the evaporator for evaporating and optionally additionally superheating the working medium by supplying heat; an expansion machine for producing mechanical energy by expanding the evaporated working medium; and at least two condensers connected in parallel between the expansion machine and the feed pump for condensing and optionally subcooling the expanded working medium. The invention further relates to a corresponding method for operating a thermodynamic cycle.

5 Claims, 5 Drawing Sheets

(51) Int. Cl.

| | |
|---|---|
| *F25B 39/02* | (2006.01) |
| *F28B 7/00* | (2006.01) |
| *F28D 15/06* | (2006.01) |

(56) References Cited

U.S. PATENT DOCUMENTS

| | | | | |
|---|---|---|---|---|
| 2003/0056647 | A1* | 3/2003 | Gottzmann | B01D 53/22 95/54 |
| 2006/0010869 | A1* | 1/2006 | Blangetti | F28B 9/10 60/646 |
| 2006/0151154 | A1* | 7/2006 | Szabo | F28B 1/06 165/112 |
| 2008/0006395 | A1* | 1/2008 | Sanderlin | F28B 1/02 165/110 |
| 2009/0188253 | A1* | 7/2009 | Smith | F01C 1/16 60/657 |
| 2011/0203279 | A1* | 8/2011 | Duong | F01K 9/00 60/670 |
| 2013/0174551 | A1* | 7/2013 | Mahmoud | F01K 25/06 60/649 |
| 2016/0070081 | A1* | 3/2016 | Chen | G02B 6/3897 398/66 |
| 2017/0307297 | A1* | 10/2017 | Aumann | F28B 9/08 |
| 2017/0320733 | A1* | 11/2017 | Kriegel | C01B 13/0251 |

FOREIGN PATENT DOCUMENTS

| | | | | |
|---|---|---|---|---|
| FR | 2984400 | A1 | 6/2013 | |
| WO | 2005119014 | A1 | 12/2005 | |
| WO | 2012034705 | A1 | 3/2012 | |
| WO | WO 2013045021 | A2 * | 4/2013 | F01K 25/10 |

* cited by examiner

DEVICE AND METHOD FOR OPERATING A THERMODYNAMIC CYCLE

TECHNICAL FIELD

The invention relates to a device and a method for operating a thermodynamic cycle, in particular an ORC process.

BACKGROUND ART

An exemplary system for producing electrical energy from heat energy consists of the following main components: a feed pump for conveying liquid working medium to an evaporator by increasing the pressure, the evaporator itself for evaporating and optionally additionally superheating the working medium by supplying heat, an expansion machine, in which the high-pressure evaporated working medium is expanded and thereby produces mechanical energy, which, for example, can be converted into electrical energy by means of a generator, and a condenser, in which the low-pressure steam (expanded working medium) from the expansion machine is subcooled and condensed. The condensed working medium returns from the condenser to the feed pump, whereby the thermodynamic cycle is closed. In the case that the working medium is an organic working medium, the thermodynamic cycle is an Organic Rankine Cycle (ORC system).

In order to avoid cavitation in the feed pump, the condensed working medium is subcooled, thus, cooled to a temperature, which is below the condensation temperature (equivalent to the boiling temperature) at the condensation pressure. In this way, the NPSH value (Net Positive Suction Head) is achieved There are basically two possibilities to implement the condenser of a thermodynamic cycle (in particular an ORC system). On the one hand, the condensation of the working medium can be liquid-operated (e.g. water-cooled) or the condensation, on the other hand, can be air-operated. Water-cooled condensation offers the advantage that the condensation heat can be fed into a heating circuit and, thus, is available to the heat consumers (e.g. a stable, a building heating system, a fermenter, etc.). If there are no heat consumers, only an air-cooled condensation is possible, however, thereby, the own requirements of a fan are at the expense of the electrical efficiency.

There are also applications for which heat consuming is desired only for a limited time of the year. If, however, the heat use and the electricity production are to be made possible by the ORC, the surplus heat has to be emitted, for example, via the emergency cooler of a combined heat and power station in the time of the year, in which a heat consumption does not take place. However, this is associated with a high power consumption and, thus, with increased costs.

Basically (according to an internal non-published prior art of the applicant), two condensers can be interconnected in order to allow both operation modes (air-cooling and liquid-cooling, in particular water-cooling). However, the difficulties here are to regulate the distribution of the mass flows of the working medium in the respective condensers and, thus, the heat emission. The aim is to enable a heat quantity, which is as large and defined as possible in a condenser integrated in a heating circuit.

In order to regulate the mass flows, mechanical valves, as, for example shut-off valves, can be used. However, this involves the problem that different pressure levels are present in both condensers. This may lead to the return flow of the condensed fluid into the condenser with the lower pressure until this condenser is completely filled up. However, by the valves to be installed, the complexity of the system as well as the error rate is increased, as the correct valve positions have to be kept for the correct operation modes.

DISCLOSURE OF THE INVENTION

The object of the invention is to overcome the mentioned disadvantages, at least partially.

This object is solved by a device according to claim 1.

The device according to the invention for operating a thermodynamic cycle, in particular an ORC process comprising: a feed pump for conveying liquid working medium to an evaporator by increasing pressure; the evaporator for preheating, evaporating and optionally additionally superheating the working medium by supplying heat; an expansion machine for producing mechanical energy by expanding the evaporated working medium; and at least two condensers connected in parallel between the expansion machine and the feed pump for deheating, condensing and optionally additionally subcooling the expanded working medium. This has the advantage that, for example, in a heating circuit, which can be supplied with heat via one of the condensers, not required heat can be emitted via said or via the other condenser(s). On the other hand, two condensers can also be operated at different temperature levels in order, for example, to supply different heating circuits with heat. In this way, the heat distribution can be flexibly regulated.

The device according to the invention can be further developed in that the at least two condensers comprise a liquid-cooled condenser and an air condenser. A water-cooled condenser is to be understood that a liquid flows through the condenser, which can absorb heat from the working medium also flowing through the condenser. In contrast, in the case of an air condenser, the air flowing through the condenser (or along its contact surfaces) is the heat-absorbing fluid.

Another embodiment is that the liquid-cooled condenser in a liquid circuit, in particular a heating circuit is provided with a pump and/or wherein the air condenser comprises a fan. With a pump and/or a fan, a heat consuming can be regulated into the liquid circuit, in particular switched on or off, and with the fan, an air-cooling of the working medium can be regulated, in particular switched on or off.

According to another embodiment, the fan and/or the pump can be controllable, in particular the rotational speed of the fan or the mass flow of the liquid conveyed by the pump. The mass flow conveyed by the pump can, for example, take place via a speed control of the pump or via a balancing valve.

Another embodiment is that each condenser can be connected to the feed pump via a siphon, wherein a minimum filling height of the condensed working medium is determined in the condenser by the vertex of the siphon. By means of a siphon in the condensate line, the liquid level in the condenser is always as high as the height of the siphon. Thereby, also a defined minimum subcooling is ensured.

According to another embodiment, furthermore, between the condensers and the feed pump, a pressure-tight container can be provided. A container between the condensers and the pump ensures that liquid working medium always flows to the pump. If operating conditions occur, in which one of the condensers drains and, thus, gaseous working medium flows in the direction of the pump, this is deposited in the container. Gas bubbles flowing along with the liquid working medium, which could cause (partial) cavitation on the feed pump, are also deposited in the container. If the container is not completely filled, and a liquid level is set, the working medium in the container aspires to a saturated state. This results in two possible cases: If the working medium is colder than the environment, it evaporates and a state of equilibrium between the liquid phase and the vaporous state occurs. However, if the working medium in the container is warmer than the ambient temperature, the heat is emitted to the environment and a condensation takes place in the container. This leads to the fact that the liquid level increases until the container is completely filled up. By impressing an additional partial pressure in the container, for example, by means of a non-condensing gas, a sufficient subcooling (distance between boiling temperature and actual temperature) can be ensured and the condensation in the container can be prevented. In other words, a sufficient positive suction head is provided by such a gas.

Another embodiment is that for each of the parallel connected condensers, a back-pressure valve is provided between the respective condenser and the feed pump and/or between the expansion machine and the respective condenser, wherein each back-pressure valve only allows a flow in the direction of the feed pump. In this way, an undesired natural circulation between the condensers can be prevented.

According to another embodiment, the device may further comprise: a temperature sensor for measuring the temperature of a liquid/heating circuit return flow, and/or a temperature sensor for measuring the temperature of a liquid/heating circuit flow line, and/or a temperature sensor for measuring the temperature of the ambient temperature; and a control device for adjusting the speed of the fan, and/or for adjusting of a mass flow of the liquid conveyed by the pump based on the measured temperature or the measured temperatures, in particular for limiting the return flow temperature to a maximum value and/or for adjusting a constant flow line temperature. Thereby, emergency cooling units in a combined heat and power station (CHP) can be prevented to be switched on, if the return flow temperature to the CHP becomes too high. On the other hand, for example, heating systems can be satisfied, which require a constant flow line temperature at different heat requirements.

The object according to the invention is further solved by a method according to claim 1.

The method according to the invention for operating a thermodynamic cycle, in particular an ORC process during normal operation comprising the following steps: Conveying liquid working medium to an evaporator with a feed pump by increasing the pressure; preheating, evaporating and optionally additionally superheating of the working medium by supplying heat in the evaporator; expanding the condensed working medium in an expansion machine; deheating, condensing and optionally additionally subcooling of the expanded working medium by at least two condensers connected in parallel between the expansion machine and the feed pump.

The advantages of the method according to the invention and its embodiments correspond—if not otherwise stated—to those of the device according to the invention.

According to an embodiment of the method according to the invention, a mass flow of the expanded working medium can be divided in mass flows of the expanded working medium into the respective condensers in a self-regulating manner by means of a pressure equilibrium.

Another embodiment is that the at least two condensers comprise an air condenser with a fan and/or a liquid-cooled condenser in a liquid circuit with a pump, and wherein the method comprises the following further step: adjusting a rotational speed of the fan and/or adjusting the mass flow of the liquid conveyed by the pump. By adjusting the rotational speed of the fan and/or the mass flow conveyed by the pump, a sliding regulation of the condensation parts can occur in the air condenser or the liquid-cooled condenser, wherein in particular by switching off the fan, little or no condensation of the working medium takes place in the air condenser, preferably while the pump is running, or wherein by switching off the pump, little or no condensation in the liquid-cooled condenser takes place, preferably while the fan is running. In this way, for example, a load alternation between the participating condensers can occur.

According to another embodiment, the following further steps can be carried out during a start-up operation carried out before normal operation: providing a sufficient positive suction head of liquid working medium in front of the feet pump in order to prevent cavitation in the feed pump, starting the thermodynamic cycle with the condenser, in which the lowest condensation pressure is present; and switching on the further condensers in the order of increasing condensation pressure. Therefore, at the beginning of the starting process, a minimum net positive suction head (NPSH) is ensured. Furthermore, a start without cavitation at the feed pump is ensured, as the pressure in front of the pump during the starting process increases monotonously.

Another embodiment is that the step of the start of the air condenser with running fan and switched off pump of the liquid circuit occurs, and wherein the step of switching on the liquid-cooled condenser occurs by switching on or increasing the conveyed mass flow of the pump.

The mentioned embodiments may be used individually or combined with one another as claimed.

Further features and exemplary embodiments as well as advantages of the present invention are described in the following in more detailed by means of the drawings. It is clear that the embodiments do not exhaust the scope of the present invention. It is further clear that some or all features of the features subsequently described may also be combined in a different manner.

DRAWINGS

FIG. 1 schematically shows a first embodiment of the device according to the invention.

EMBODIMENTS

When operating an ORC system with two parallel condensers, there are different operating states, for which particular operating parameters are to be ensured, respectively. The operating states to be considered are: start-up, stationary operation, load alternation between heat condenser and air condenser operation, and parallel operation of heat condenser and air condenser.

The operating parameters to be ensured are: appropriate fluid distribution for the load cases 100% air condenser operation, 100% heat condenser operation and parallel operation, as well as sufficient positive suction head for the feed pump in the different operating modes.

In the simplest embodiment of the ORC system, the necessary operating parameters can be achieved in all different operating modes via control-technological methods as well as an appropriate arrangement of components and a corresponding filling quantity with working medium. Additional components such as valves, etc. are not required. In the following, the devices and methods are described, by means of which the operating parameters may be kept in the simplest embodiment.

Figure 1:
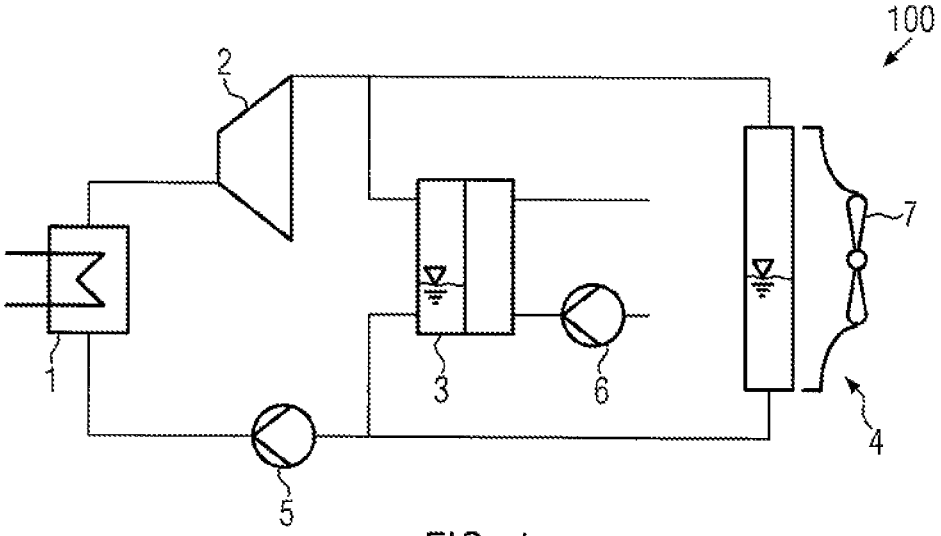

FIG. 1 shows the standard wiring of the system in a simplified manner. The liquid working medium is preheated, evaporated in the heat exchanger (evaporator) 1 by supplying heat, and subsequently expanded in an expansion machine 2 (e.g. screw expander, turbine). Downstream of the expansion machine, the distribution of the working medium mass flow takes place to the liquid-cooled condenser (heat condenser) 3 and the air condenser 4 (with a fan 7).

During condensation of the working medium in the heat condenser, heat is emitted to the heating water system, wherein the heating water is circulated via a pump 6. The circuit is closed by a feed pump 5 increasing the pressure of the working medium to the evaporation pressure and conveying it repeatedly into the evaporator 1. In the wiring, the flow of the working medium or the distribution of the working medium is not regulated via valves, but occurs merely thermally driven.

1. Start-Up

For the operation of an ORC system with two condensers, it is important to ensure a reliable system start. In order to ensure a start without cavitation at the feed pump, it is required to increase the pressure in front of the feed pump monotonously, moreover, at the beginning of the starting process, a minimum net positive suction head $NPSH_r$ has to be ensured In case of a switched off, cold system, a low condensation pressure with low condensation temperature occurs. Even in case of a warm heat condenser, the condensation pressure due to the heat emission to the environment via the air condenser, will assume the saturation pressure at ambient temperature. During the starting process, the condensation pressure now increases, whereby also the condensation temperature increases. If the pressure is now dropped in front of the pump, heated working medium with low pressure would be present. Thus, the present subcooling of the working medium decreases, which may lead to cavitation in the pump. Consequently, it has to be ensured that sufficient subcooling always prevails during the starting process. This may be achieved by two ways. On the one hand, via the filling height and the fluid distribution in the condensers, a subcooling must be ensured, which allows pressure fluctuation without the risk of cavitation. On the other hand, it can be ensured via the regulation that during the starting process, the condensation pressure increases monotonously. This may be achieved due to the fact that the system is started in the air condenser operation. Thus, the system starts its operation under low pressure. Subsequently, the system smoothly turns into the heat condenser operation. If the temperature of the heat condenser is higher than the ambient temperature (which almost always applies), the condensation pressure will slowly increase monotonously.

TABLE 1

(starting process):

| Phase | Heating condenser | Air condenser | Condensation pressure | Position working medium |
|---|---|---|---|---|
| 1. System switched off | warm, since on temperature due to heating water | cold, since cooled due to ambient air | low (saturation at ambient air temperature) | in the air condenser |
| 2. System start (beginning) | warm | cold, growing warmer | increases | still in the air condenser, since the heat condenser temperature is still higher than the condensation temperature, which is defined by the air condenser |
| 3. System start (progressed) | warm | warm | further increased | Depending on the state of equilibrium, divided in the air condenser and the heat condenser |
| 4. System start (completed) | warm | warmer than the heat condenser | high | working medium mainly in the heat condenser |

Figure 2:
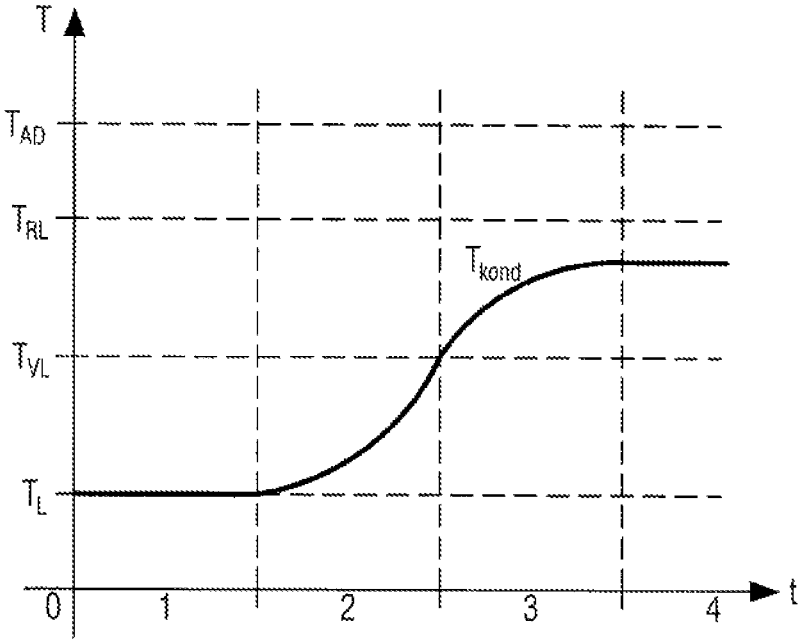
FIG. 2 shows the course of the condensate temperature during the starting process.

Table 1 shows the sequence of the starting process. In phase 1, the system is switched off. The condensate temperature and, thus, the condensation pressure are low (see FIG. 2). The condensate temperature $T_{kond}$ is equal to the temperature of the ambient air $T_L$.

Figure 3:
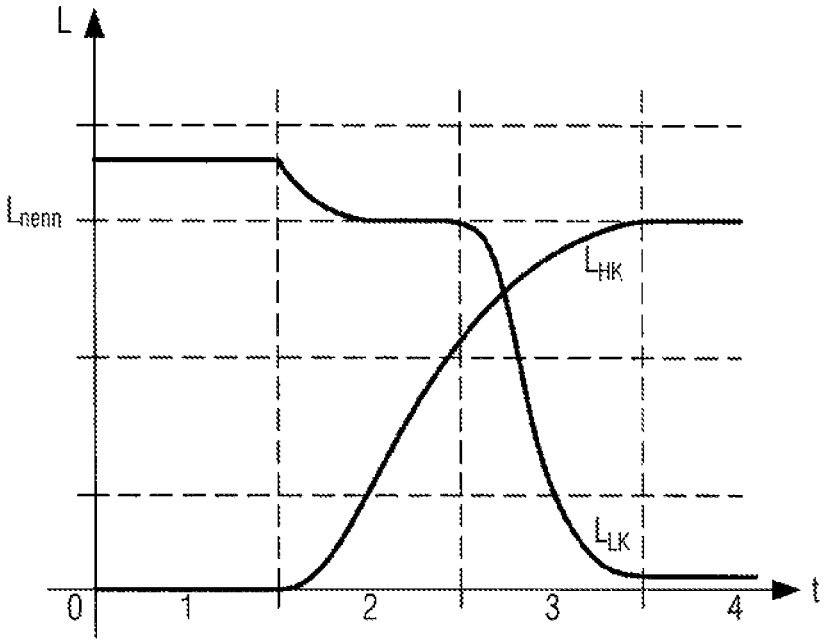
FIG. 3 shows the filling height in the air condenser and the heat condenser.

In phase two, the system is started, the condensation pressure slowly increases. Fluid begins to move into the heat condenser (see FIG. 3). The filling height $L_{HK}$ increases in the heat condenser. The condensate temperature increases to the temperature $T_{VL}$ of the flow line in the heating system. From the condensate temperature, which allows a condensation in the heat condenser (phase 3), the condensation in the heat condenser takes place substantially. The filling height LHC in the air condenser is reduced in this phase. The condensate temperature approaches the temperature $T_{RL}$ of the return flow in the heating system. In phase 4, the start is completed and a mere heat condenser operation is active.

2. Stationary Operation

In the stationary operation, the working medium will always flow into the colder condenser, since a lower pressure prevails there. Due to the self-regulating system, the colder condenser is the one, in which the condensation shall take place. In the air condenser operation, the air condenser is flowed through with cold outside air, while the heat condenser in the stationary state assumes the temperature of the exhaust steam. This results in a lower pressure in the air condenser and the fluid (working medium) flows to the condensation through the air condenser. The condensation heat is emitted to the ambient air. In the heat condenser operation, the heat condenser is flowed through with the return flow of the heating water. This is colder than the exhaust steam temperature. Since the air condenser, when the fans are switched off, assumes a temperature (due to heat loss, only) near the temperature of the exhaust steam, the condensation takes place in the colder heat condenser.

100% heat condenser or 100% air condenser operation:

The 100% operation conditions are achieved by switching off or reducing the performance of the fans or the heating water circulation pump, respectively, so that in one of the condensers, no heat can be emitted. Since the condensers on the working medium side are not separated by valves, a small part of the exhaust steam always flows through the non-required condenser and is cooled by natural convection or heat conduction.

The sufficient positive suction head of the working medium in front of the feed pump is adjusted by the filling height and the geodetic height of the liquid column above the pump. The geometric relationships between the heat condenser and the air condenser are thereby selected such that at the same filling quantity and operation of respectively one condenser, as much working medium is present in the condenser as required to achieve a sufficient subcooling. In the following section, the positive suction head required in the parallel operation of both condensers, is described in more detail.

Self-Stabilizing Method:

The method described here is self-stabilizing. This means that the condenser with the higher heat emission, always has the highest filling level, as well. This is due to the fluidic distribution of the fluids. There is always a state of equilibrium, in which there are no pressure differences between the two condensers. The total head $p_{ges}$ to be considered for this, is composed of the prevailing condensation pressure $p_{kond}$ and the geodetic pressure $\Delta p_{geod}$, which is adjusted via the filling level $\Delta_h$, respectively.

$$\Delta p_{geod}=\rho\cdot g\cdot\Delta l$$

$$p_{ges}=p_{kond}+\Delta p_{geod}$$

Figure 4:
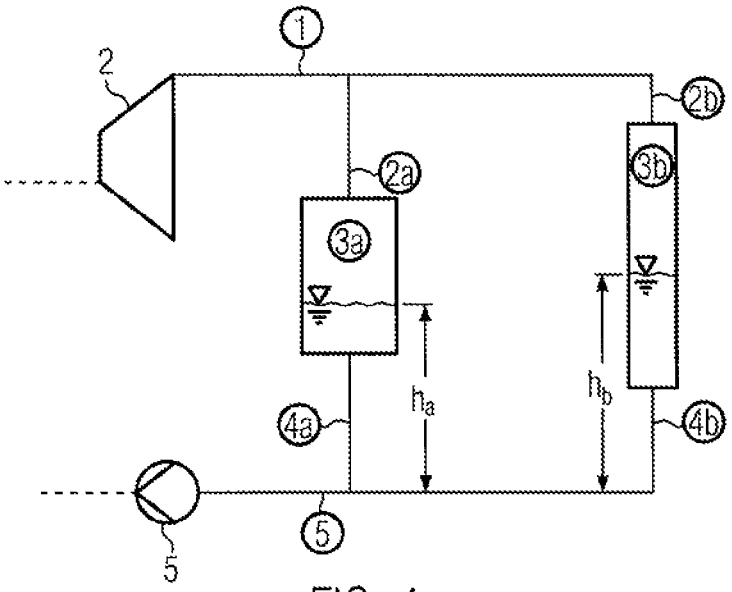
FIG. 4 shows the height ratios and filling levels of the condensers.

If it is exemplarily assumed that in condenser b more heat is emitted than in condenser a, then, in view of the process parameters, the following table is valid (see FIG. 4 for illustration):

TABLE 2

(process parameter in FIG. 4):

| Position | Parameter | |
|---|---|---|
| 1 | V_dot, p | a = b |
| 2 | V_dot | a < b |
| 3 | p_kond | a > b |
| 4 | p_geod. | a < b |
| 5 | V_dot, p | a = b |
| | h | a < b |
| | Q_dot | a < b |

In the table, the process parameters V_dot identify the volume flow, p_kond the condensation pressure, p_geod the geodetic pressure, h the filling height, and Y_dot the heat flow. The positions 1 to 5 correspond for the respective condenser a or b to: after the expansion machine and before the division of the entire mass flow V_dot, p (Position 1), after the division and before the entry into the condenser (Position 2), in the condenser (Position 3), after the condenser and before combining the partial mass flows (Position 4) after combining and before the feed pump (Position 5). The comparison relates to the respective process parameters with regard to the two condensers a and b.

The higher volume flow in the direction of condenser b results in higher pressure losses than in condenser a (path 1 to 3*a/b*). Due to the higher pressure loss, the condensation pressure in condenser b must be smaller than in condenser a. Since both condensers are connected to one another, a pressure balance occurs via the geodetic pressure. This causes the filling level in the condenser b to increase to such an extent that there is no pressure difference between the condensers at point 5. Via the higher filling height, it is ensured that in the condenser, in which more heat is emitted, thus, in which also the larger part of the exhaust steam is condensed, a sufficient subcooling of the working medium flow is achieved and therefore, as well, a sufficient positive suction head before the pump is ensured.

In order to ensure a stable operation, the filling quantity of the system must be chosen such that none of the two condenser drains. Ideally, the filling quantity and the structural height of the condensers to one another interact such that for the moment, no or only minimal fluid is present in the respective unused condenser (100% heat condenser or 100% air condenser). This reduces heat losses and helps saving fluid.

3. Load Alternation Between Heat Condenser and Air Condenser

By the self-regulating principle, the load alternation is achieved due to fact that by adjusting the rotational speed of the fan and/or the mass flow conveyed by the pump, a sliding regulation of the condensation parts in the air condenser or in the liquid-cooled condenser occurs, in particular by switching off fans or heating pumps, respectively. This results in an increase of the pressure in the unused condenser and the condensation takes place in the other condenser, in which a lower pressure prevails.

4. Parallel Operation Between Heat Condenser and Air Condenser

If the full heat output is not required in the heating system, only a part of the heat emitted by the ORC system can be condensed into the heating system. The other part will then be emitted via the air condenser. Both condensers are operated in parallel. The parallel operation is achieved, for example, by operating the fans of the air condensers in part load. Thereby, regulation parameter may be a maximum temperature of the heating circuit return flow. In case of a too high heat input by the ORC into the heating circuit, the temperature of the return flow in the combined heat and power station (CHP) may increase. If this exceeds a certain maximum value, the emergency cooler is switched on in order to emit the heat surplus from the system. In order to avoid this, the ORC system must reduce the inputted thermal power at an early stage.

Figure 5:
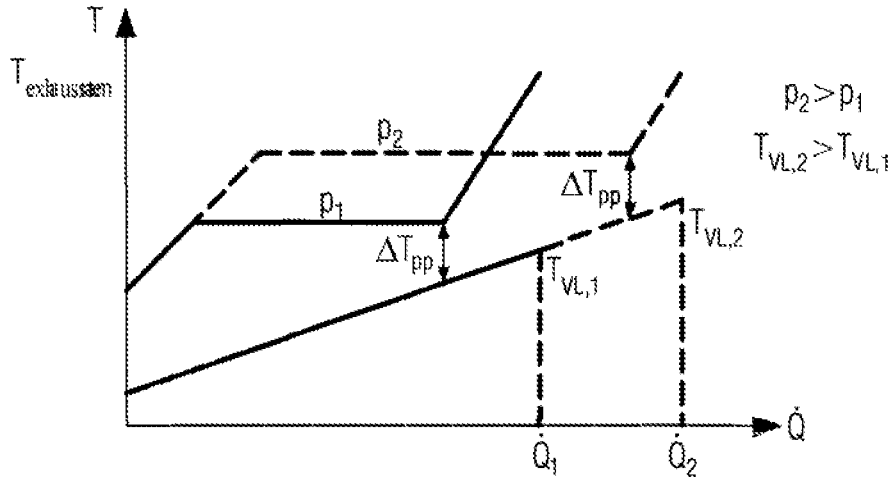
FIG. 5 illustrates the change in the heat quantity decoupled in the heat condenser without regulation of the heating water circulation pump and, thus, the change in the flow line temperature in the heating water.

The desired flow line temperature may be another regulation parameter for the heating system. Due to a reduction of the fan rotational speed, less heat is emitted in the air condenser. Thereby, the condensation pressure increases from $p_1$ to $p_2$ and a part of the exhaust steam flows into the heat condenser and there rises the heat emission into the heating system. In case of an identical water volume flow (unregulated operation of the heating water circulation pump), the outlet temperature (=flow line temperature $T_{VL}$)

of the heating water increases from $T_{VL,1}$ to $T_{VL,2}$ (see FIG. 5). Therefore, the system can react to a changing customer's heat demand and input more heat into the heating system, if this is required. However, equally, an excessively large heat input is also prevented. If the heat customer does not consumes the heat, the return flow temperature (coming from the heating system) increases and, thus, also the flow line temperature. If a limit temperature is reached here, the system counteracts this and outputs more heat via the air condenser, by increasing the fan rotational speed again.

Figure 6:
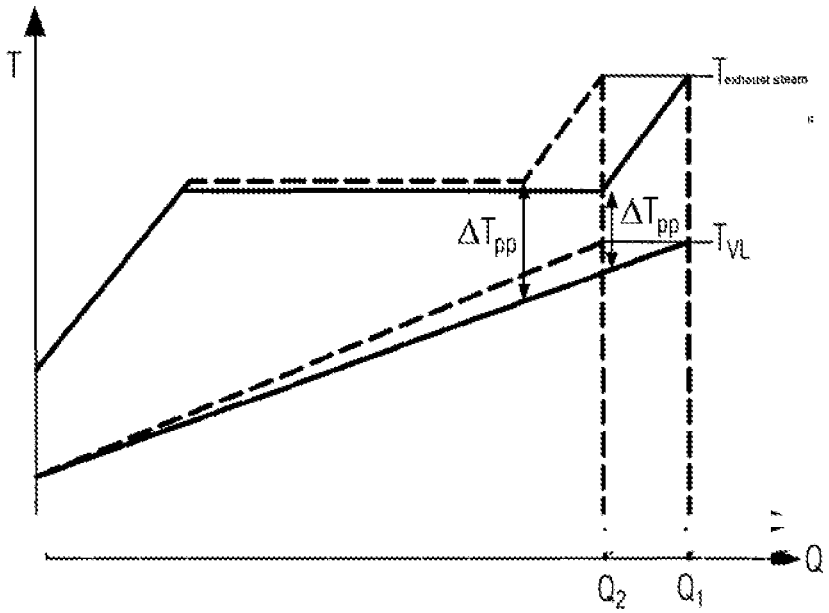
FIG. 6 illustrates the change in the heat quantity decoupled in the heat condenser with the same flow line temperature in the heating water at the same time, with regulation of the heating water circulation pump.

Additionally or alternatively to this, the heating water circulation pump may also be regulated, which allows a constant flow line temperature $T_{VL}$ in the heating system (see FIG. 6). Thus, heating systems may be supplied, which require a constant flow line temperature with different heat requirements (for example, for temperature-sensitive processes, or for hygienization, etc). By means of a regulation of the heating water circulation pump, the performance of the pump may be adjusted to the actual heat requirement and, thus, the efficiency of the system may be increased.

The sufficient positive suction head by means of corresponding subcooling of the fluid (working medium) is ensured by the self-regulating principle described under point 2. By means of a sufficient filling quantity with working medium it must be ensured that when dividing the working medium to both condensers, also a sufficient subcooling is present.

The simple ORC system with two condensers may be improved by various variations of the wiring so that the required operating parameters can be observed more securely (see FIG. 7).

Figure 7A:
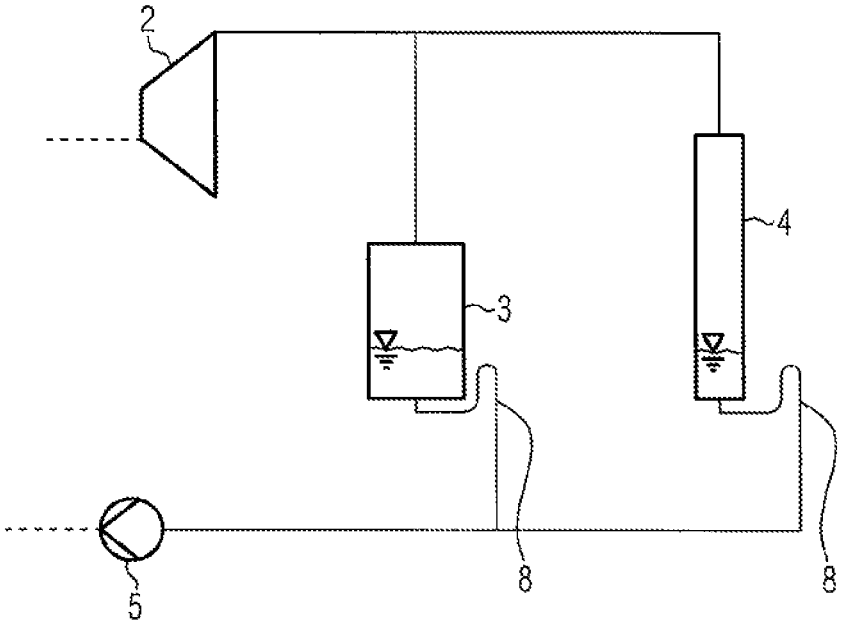
FIG. 7 shows further embodiments of the device according to the invention, in particular with a siphon (FIG. 7*a*) and/or a container (FIG. 7*b*), and/or with back-pressure valves (FIG. 7*c*).

1. Mounting a Siphon (FIG. 7*a*)

By means of a siphon 8 in the condensate line, a minimum filling height can be determined in the condenser 3, 4, since the liquid level in the condenser must always be as high as the height of the siphon. Thereby, also the defined minimum subcooling is ensured.

Figure 7B:
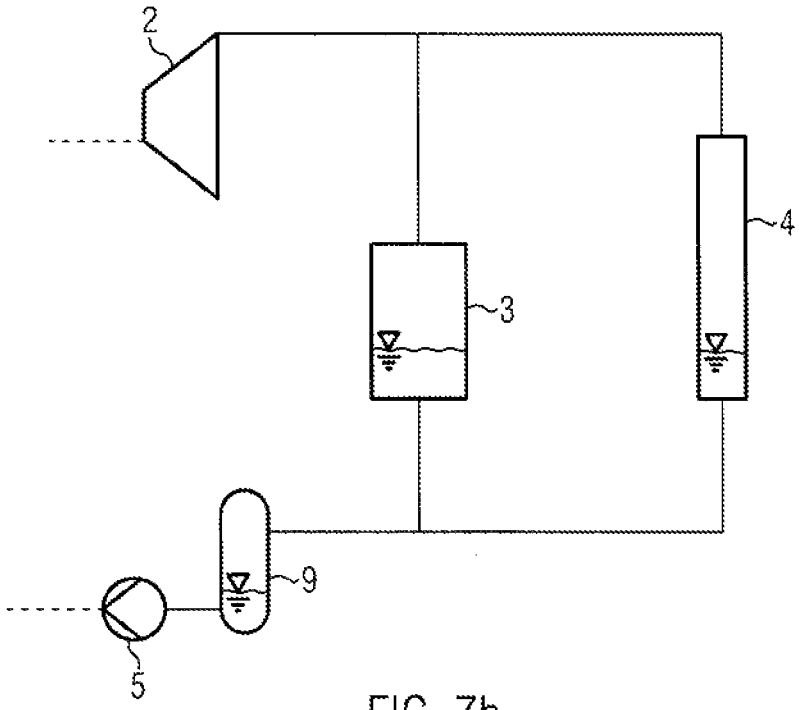

2. Container (FIG. 7*b*)

A container 9 between the condensers 3, 4 and the feed pump 5 ensures that liquid working medium always flows to the pump. If operation conditions occur, in which one of the condensers drains and, thus, gaseous working medium flows in the direction of the pump, this is deposited in the container. Gas bubbles, as well, flowing along with the liquid working medium, which could cause (partial) cavitation on the feed pump, are also deposited in the container. If the container is not completely filled, and a liquid level is set, the working medium in the container aspires to a saturated state. This results in two possible cases: If the working medium is colder than the environment, it evaporates and a state of equilibrium between the liquid phase and the vaporous state occurs. However, if the working medium in the container is warmer than the ambient temperature, the heat is emitted to the environment and a condensation takes place in the container. This leads to the fact that the liquid level increases until the container is completely filled up. By impressing an additional partial pressure in the container, for example, by means of a non-condensing gas (see e.g. patent DE 10 2009 053 390 B3 on cavitation prevention), a sufficient subcooling is generated.

Figure 7C:
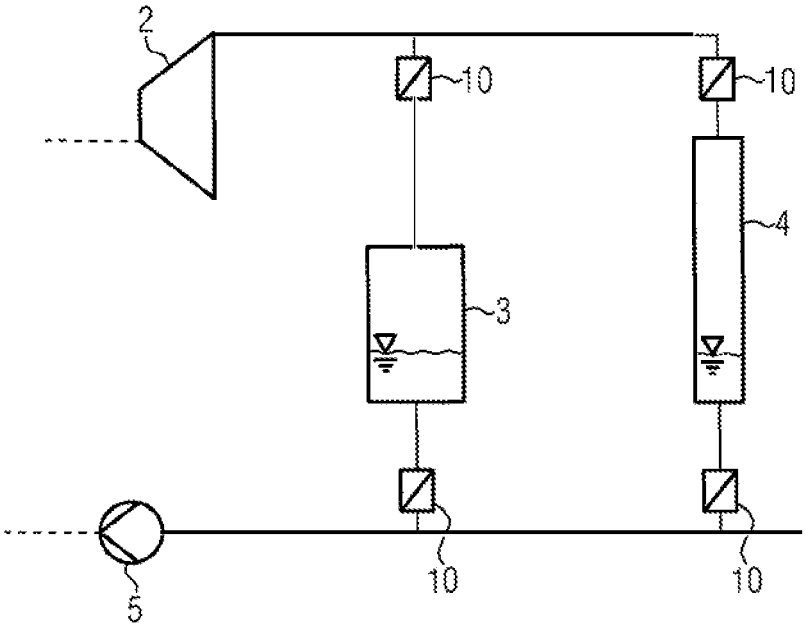

3. Back-Pressure Valves (FIG. 7*c*)

Figure 8:
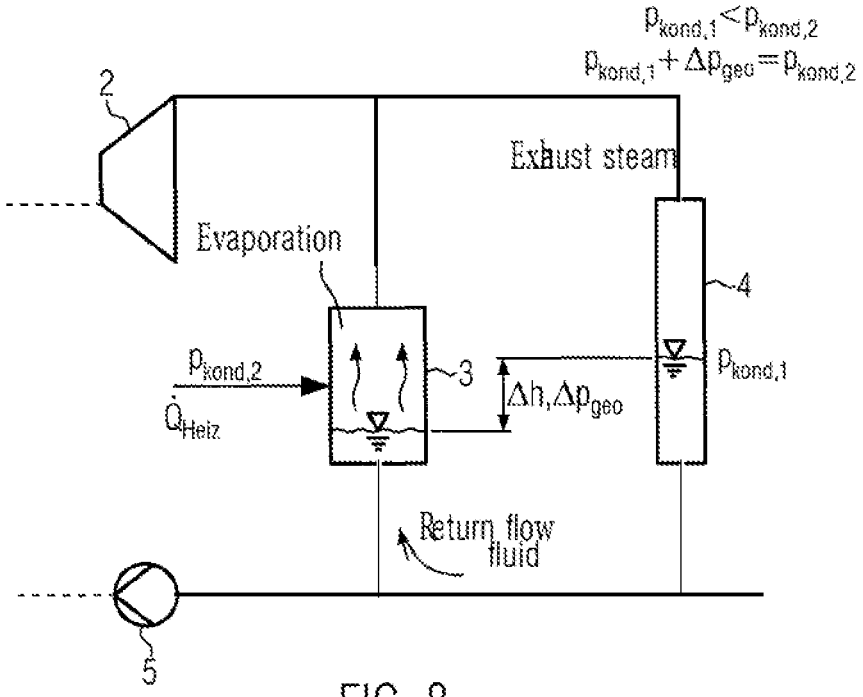
FIG. 8 shows the formation of a natural circulation during heating of the unused condenser 3.

In certain cases, an undesirable natural circulation may occur between heat condenser 3 and air condenser 4 (see FIG. 8). If the unused condenser 3 is nevertheless heated, e.g. flowed through with hot heating water, evaporation occurs therein. The thereby falling filling level would unbalance the pressure equilibrium of the condensation pressure and the geodetic pressure due to different filling heights. In order to maintain this equilibrium, additional condensed working medium flows from the condenser 1. By means of installing back-pressure valves 10, either in the exhaust or the condensate line, this phenomenon is avoided.

The illustrated embodiments are only exemplary and the full scope of the present invention is defined by the claims.

The invention claimed is:

1. A method for operating a thermodynamic cycle, the method during normal operation comprising the following steps:

conveying liquid working medium to an evaporator by increasing a pressure by a feed pump;

evaporating the liquid working medium by supplying heat in the evaporator;

expanding the evaporated working medium in an expansion machine;

condensing the expanded working medium with at least two condensers connected in parallel between the expansion machine and the feed pump, wherein during a start-up operation carried out before normal operation, the method further comprises:

providing a sufficient positive suction head of liquid working medium in front of the feed pump in order to prevent cavitation in the feed pump;

starting the thermodynamic cycle with one of the least two condensers, in which a lowest condensation pressure is present; and switching on remaining ones of the at least two condensers in the order of increasing condensation pressure.

2. The method according to claim 1, wherein a mass flow of the expanded working medium is divided in mass flows of the expanded working medium into the respective ones of the at least two condensers in a self-regulating manner by means of a pressure equilibrium.

3. The method according to claim 1, wherein the at least two condensers comprise an air condenser with a fan and/or a liquid-cooled condenser in a liquid circuit, and the method comprising the following further step:

adjusting a rotational speed of the fan and/or adjusting a mass flow of the liquid conveyed by the feed pump, wherein by switching off the fan, no condensation of the working medium takes place in the air condenser while the feed pump is running, or wherein by switching off the feed pump, no condensation takes place in the liquid-cooled condenser while the fan is running.

4. The method according to claim 3 further comprising a step of:

starting with a running fan of the air condenser and a switched off pump of the liquid circuit, wherein the step of switching on the liquid-cooled condenser comprises switching on or increasing the conveyed mass flow of the feed pump.

5. The method according to claim 1, wherein the thermodynamic cycle is an Organic Rankine Cycle (ORC).

* * * * *